US010222062B2

(12) United States Patent
Benum et al.

(10) Patent No.: US 10,222,062 B2
(45) Date of Patent: Mar. 5, 2019

(54) INDUSTRIAL FURNACE

(71) Applicant: NOVA Chemicals (International) S.A., Fribourg (CH)

(72) Inventors: Leslie Wilfred Benum, Red Deer (CA); Eric Clavelle, Calgary (CA); Grazyna Petela, Calgary (CA); Randall E Saunders, Red Deer (CA); Mark Williamson, Red Deer County (CA)

(73) Assignee: NOVA Chemicals (International) S.A., Fribourg (CH)

( * ) Notice: Subject to any disclaimer, the term of this patent is extended or adjusted under 35 U.S.C. 154(b) by 40 days.

(21) Appl. No.: 15/444,726

(22) Filed: Feb. 28, 2017

(65) Prior Publication Data

US 2017/0167727 A1 Jun. 15, 2017

Related U.S. Application Data

(62) Division of application No. 14/012,024, filed on Aug. 28, 2013, now Pat. No. 9,618,204.

(30) Foreign Application Priority Data

Sep. 14, 2012 (CA) ..... 2789642

(51) Int. Cl.

| | |
|---|---|
| ***F23N 3/00*** | (2006.01) |
| ***F23N 5/02*** | (2006.01) |
| ***F23N 5/00*** | (2006.01) |
| ***F27D 19/00*** | (2006.01) |

(52) U.S. Cl.

CPC ..... *F23N 3/002* (2013.01); *F23N 5/003* (2013.01); *F23N 5/02* (2013.01); *F23N 5/022* (2013.01); *F27D 19/00* (2013.01); *F27D 2019/0003* (2013.01); *F27D 2019/0021* (2013.01); *F27D 2019/0043* (2013.01)

(58) Field of Classification Search

CPC ..... F24H 9/2035

See application file for complete search history.

(56) References Cited

U.S. PATENT DOCUMENTS

| | | | | |
|---|---|---|---|---|
| 4,749,122 | A | 6/1988 | Shriver et al. | |
| 5,261,811 | A | 11/1993 | Bae | |
| 6,216,685 | B1 * | 4/2001 | Payne | F23J 11/02 126/80 |
| 7,278,828 | B2 | 10/2007 | Steplewski et al. | |

(Continued)

FOREIGN PATENT DOCUMENTS

| | | |
|---|---|---|
| CA | 2 746 285 A1 | 9/2012 |

*Primary Examiner* — David J Laux

(74) *Attorney, Agent, or Firm* — Lawrence T. Kale

(57) ABSTRACT

The dry oxygen content in the exhaust of an industrial furnace may be controlled to 1% or less by determining one or more of: the temperature of: each or a group of one or more burner (flame); one or more section of the radiant walls adjacent (e.g., within 5 feet of the burner); the temperature gradient across the process coils; the combustion products of one or more burners; the mass flow rate or the volume flow rate of air to each burner (e.g., the pressure drop across the variable forced air aperture ii) comparing the result to said target value; and iii) adjusting either a) the opening of the variable forced air aperture; or b) adjusting the mass flow rate or the volume flow rate of air from said one or more fans.

9 Claims, 1 Drawing Sheet

(56) References Cited

U.S. PATENT DOCUMENTS

| | | | | |
|---|---|---|---|---|
| 7,838,297 | B2 | 11/2010 | Widmer et al. | |
| 2008/0110800 | A1* | 5/2008 | Peters | C10G 35/02 208/63 |
| 2009/0308292 | A1* | 12/2009 | Fujimori | F23K 1/04 110/185 |
| 2011/0056416 | A1* | 3/2011 | Widmer | F22B 35/00 110/185 |

* cited by examiner

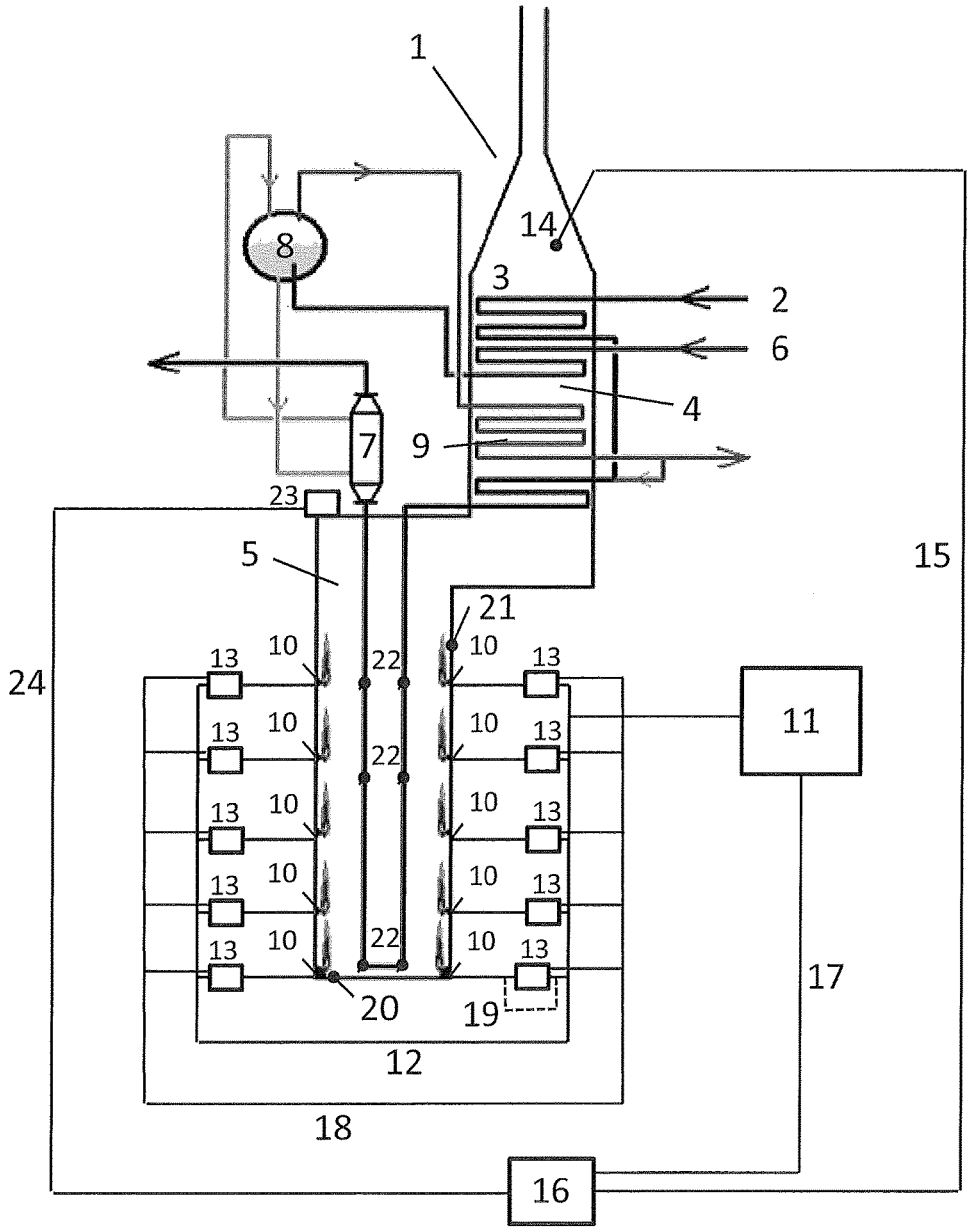
1
14
8
3
2
6
4
7
9
23
5
15
21
24
13
10
22
11
20
19
12
17
18
16

INDUSTRIAL FURNACE

CROSS REFERENCE TO RELATED PATENT APPLICATION

This application is a divisional of U.S. application Ser. No. 14/012,024, filed on Aug. 28, 2013, entitled "Industrial Furnace", which is herein incorporated by reference in its entirety.

FIELD OF THE INVENTION

The present invention relates to an improved furnace and its method of operation to achieve complete combustion in the furnace burners but minimize the oxygen (dry) content in the exhaust gas. This is achieved by monitoring one or more indicators relating to combustion efficiency for each or a group of burners and adjusting the flow of oxygen to those burners not operating in an efficient manner to reduce the unconsumed oxygen in the exhaust gas.

BACKGROUND OF THE INVENTION

Industrial furnaces are used in many applications from boilers to cracking furnaces. A broad range of fuels are burned in such furnaces for example from bunker oil to natural gas enriched with hydrogen. With an increase in the cost of petrochemical fuels and a heightened awareness of emissions one would have thought that the application of microprocessors would be applied to furnace combustion in general and combustion at one or a number of burners. A significant amount of art in this field has not been located.

U.S. Pat. No. 4,749,122 issued Jun. 7, 1988 to Shriver et al. assigned to the Foxboro Company relates to a combustion control system. The fuel appears to be low cost solid fuel and the "combustion device" appears to be a grating. The patent does not seem to refer to multiple fluid fired burners. The patent teaches to control oxygen to fuel ratios based on the overall heat balance of the furnace.

U.S. Pat. No. 5,261,811, issued Nov. 16, 1993 to Bae, assigned to SamSung Electronics Company Ltd., teaches regulating the flow of fuel and oxygen (air) to a burner by balancing the load on the fan supplying air to the burner and the load on the pump for fuel to the burner. The patent does not teach measuring a number of parameter extrinsic to the fuel pump.

U.S. Pat. No. 7,838,297, issued Nov. 23, 2010 to Widmer et al., assigned to General Electric Company, relates to a coal fired power plant. The patent teaches using a grid of sensors selected from the group consisting of unburned carbon or loss on ignition CO sensors, $CO_2$ sensors, $NO_x$ sensors, $O_2$ sensors, total hydrocarbon (THC) sensors, volatile organic compound (VOC) sensors, sulphur dioxide ($SO_2$) sensors, heat flux sensors, radiance sensors, opacity sensors, emissivity sensors, moisture sensors, hydroxyl radical (OH) sensors, sulphur trioxide ($SO_3$) sensors, particulate matter sensors, and temperature sensors. The grid is arranged so that the combustion characteristics of each burner may be monitored. In response to "a spatial imbalance" in the furnace, the air flow to one or more burners is adjusted to restore or achieve "spatial uniformity". However, the identification of the burner acting in an anomalous manner is not done directly. Rather, the patent teaches at col. 4, lines 31 to 35. "Identifying 60 burners responsible for the spatial combustion anomalies includes tracing burners 28 to corresponding sensors. Particularly, tracing the burners can be accomplished by computational flow modeling, isothermal flow modeling, and/or empirically by adjusting individual burner air settings and noting changes to sensor output data." The present invention is not so much concerned about burner operation but rather minimizing the amount of air required for complete combustion at each burner.

The present invention seeks to provide a furnace having a simple fairly direct method for measuring the performance of one or a group of burners and reducing the amount of excess air/oxygen being fed to the furnace and burners to reduce greenhouse emissions, reduce noxious emissions and to reduce the heat load on the furnace to heat unnecessary air/oxygen.

SUMMARY OF THE INVENTION

The present invention provides a balanced forced air draft furnace (and its operation) comprising one or more fans, one or more air ducts leading to an array of two or more burners for burning a fluid fuel, each burner associated with a controller and a variable forced air aperture that controls the air flow to the burner having a control fidelity of 1% of the air flow at its maximum flow rate, the improvement of controlling the air flow to each burner so that the oxygen content in an exhaust gas at a furnace exit (arch) is from 0.5% to 1% dry oxygen and the distribution of air to said burners is at a target value:

i) taking a measurement of one or more of:
   a) the temperature of said one or more burners (flame), or optionally the temperature of a group of two or more burners (flame);
   b) the temperature of one or more section(s) of the radiant walls adjacent to a burner (e.g., within 5 feet of the burner);
   c) the temperature gradient across the process coils;
   d) one or more combustion products produced by one or more burners, or optionally one or more combustion products produced by said group of two or more burners;
   e) the mass flow rate or the volume flow rate of the air flow to each burner (e.g., the pressure drop across the variable forced air aperture), ii) comparing said measurement to said target value;

iii) making an adjustment, either
   a) said adjustment increases or decreases the opening of the variable forced air aperture; or
   b) said adjustment changes the mass flow rate or the volume flow rate of said air flow from said one or more fans, so that the adjusted air flow to said one or more burners, or optionally said group of burners, achieves the target value; and iv) adjusting the mass flow rate or the volume flow rate of air from said one or more fans to achieve an oxygen content of 1% or less of dry oxygen content in said exhaust gas.

In a further embodiment, the present invention provides controlling the air flow to each burner to achieve an oxygen content of 0.8% dry oxygen or less in said exhaust gas, above the stoichiometric level, i.e., above the level required for complete combustion.

In a further embodiment of the present invention, the variable forced air aperture comprises a mechanical iris.

In a further embodiment of the present invention, the variable forced air aperture comprises a damper.

In a further embodiment of the present invention, the variable forced air aperture comprises two or more ½ moon shaped discs on a common pivot point movable relative to each other.

In a further embodiment of the present invention, the variable forced air aperture comprises two or more ¼ moon shaped discs on a common pivot point movable relative to each other.

In a further embodiment of the present invention, the variable forced air aperture comprises two or more plates having multiple small diameter holes (¼ inch or less) in each plate; said plates being rotatably mounted relative to each other and rotating the plates to increase or decrease the air flow.

In a further embodiment of the present invention, the variable forced air aperture comprises a valve.

In a further embodiment of the present invention, the measurement(s), from step i), is fed to a microprocessor having been programmed with the target value(s), software compares the measurement(s) to the target value and the microprocessor communicates with the controller to make an adjustment; wherein the adjustment increases or decreases the opening in the variable forced air aperture to achieve the target value.

In a further embodiment of the present invention, the measurement(s), from step i), are obtained by one or more probes at the point of measurement.

In a further embodiment of the present invention, the measurement(s), from step i), are obtained by one or more devices distant from the point of measurement.

In a further embodiment of the present invention, the measuring devices are selected from the group consisting of lasers and cameras.

In a further embodiment of the present invention, the target value is defined by the initial set up of the furnace.

In a further embodiment of the present invention, the target value is defined by the air requirement of each burner at its fuel consumption rate. In a further embodiment of the present invention, the target value is defined by the air/fuel ratio requirement for each burner, for the given fuel gas composition.

In a further embodiment of the present invention, the measurement(s), from step i), is taken on a periodic basis from once per second to once every 30 days.

The present invention also provides a furnace comprising an exhaust, one or more combustion chambers having a series of fluid fuel burners having one or more associated variable forced oxidant (air or oxygen or mixtures thereof) apertures and an associated controller that controls an oxidant flow to each fuel burner having a control fidelity of 1% of said oxidant flow at its maximum flow rate; a fan and a duct system attached to and feeding said one or more forced oxidant apertures, and one or more probes taking a measurement of one or more of:

a) the temperature of each fuel burner (flame), or optionally the temperature of a group of two or more fuel burner(s) (flame);

b) the temperature of one or more section(s) of the radiant wall(s) adjacent to a burner (e.g., within 5 feet of the burner);

c) the temperature gradient across one or more process coils;

d) one or more combustion product(s) produced by of one or more fuel burners, or optionally one or more combustion products(s) produced by said group of two or more fuel burners;

e) the mass flow rate or the volume flow rate of said oxidant flow to each fuel burner (e.g., the pressure drop across the variable forced oxidant aperture), a microprocessor connected to said probes, said microprocessor being programmed to compare a desired operating condition(s) to said measurement(s) obtained from said probes, said microprocessor communicating with said controller makes an adjustment to said variable forced oxidant apertures; wherein said adjustment increases or decreases the opening in the aperture, increasing or decreasing said oxidant flow, to achieve said desired operating conditions.

BRIEF DESCRIPTION OF THE DRAWING

FIG. 1 is a schematic diagram of an ethylene furnace using the present invention.

DETAILED DESCRIPTION OF THE INVENTION

The furnace of the present invention may be used in any conventional application. One particularly useful application is in the cracking of chemical feedstocks, preferably ethane, but the furnace could also be used with a naphtha feed or mixed feeds.

In a cracker 1, such as an ethylene cracker, the feed stock 2 enters a coil 3 typically passing through the exhaust area 4, typically referred to as the convection section or the arch. The feed is preheated in the arch to a controlled level of temperature. Typically in a cracker, steam is also fed to the arch 4 through a parallel set of coils 6 to preheat it. At the back end of the cracker is a quench unit 7 which cools the cracked gas and heats water in a heat exchanger 8 to generate steam. Steam from the heat exchanger 8 is fed through a separate set of coils 9 in the arch 4 to further pre heat the feedstock.

The coil 3 containing the feed exits the arch and typically travels through the furnace radiant section 5. In the furnace section, the coil may also be serpentine in configuration. There are a number of furnace configurations such as a single radiant section (fire box per the FIGURE), parallel radiant sections (fire boxes), or it may comprise two radiant sections (fire boxes) in series, one cooler (cold box) and one hotter (hot box). However, both radiant sections typically share a common exhaust or arch 4.

The feed flowing in the coil 3 is further heated in the furnace radiant sections by a number of burners 10, fed with a hydrocarbon fuel. The fuel lines are not shown in the FIGURE but would be comparable to the air or oxygen duct and controller system described below and shown in the FIGURE. The fuel mass flow rate or volume flow rate is controlled at the source of the fuel to the burners. In optional embodiments each burner has a fuel flow controller. Preferably the fuel is a fluid, most preferably a gas such as natural gas or natural gas mixture with other combustible gases, such as hydrogen. Low pressure combustion air is provided to burners 10 from a fan 11 through a duct system 12. Each burner 10 has an associated variable air or oxygen flow controller 13 such as a damper or valve. The air flow controller should have a fidelity for the flow rate (mass or volume) of 1% or less. That is the flow rate should be able to be controlled in increments of 1% or less.

Mechanical or electrical devices to control the positioning of the damper or discs relative to each other are known such as springs, worm gears, solenoids, and the like with associated actuators. Other methods for controlling the positioning of mechanical elements relative to each other are well known to those skilled in the art.

The control system for the furnace comprises a number of sensors or probes. In the arch 4, there is an oxygen probe 14 connected by electrical or optical cable 15 to a microprocessor 16. The microprocessor 16 is connected by an electrical or optical cable 17 to the fan 11. Oxygen probe 14 measures the amount of dry oxygen in the exhaust gases exiting the furnace. The amount of dry oxygen in the exhaust gas should be 1% or less. Increasing or decreasing the air fan speed or adjusting a set of fan louvers is used to control the amount of air supplied to the burners and, thus, dry oxygen in the exhaust gases. This is a bulk air system control and does not adjust an individual burner for preferred performance. However, in some circumstances, all that may be necessary is a change in the flow rate from fan 11 through the duct system 12 to the burners 10 to bring the furnace back to a desired range of operation. This does not involve any adjustment of the flow of air or oxygen to a burner or an array of burners.

There are a number of measurements which can be taken for a single burner or a group of burners (an array of burners) to achieve the preferred performance of the burner or group of burners. For simplicity, in FIG. 1, the probes are shown on one burner or location. However, it is noted that the probes may be applied to each burner, or a number of selected burners (an array of burners).

Microprocessor 16 is connected by one or more electrical or optical cable(s) 18 to each air flow controller 13, and it can process the signals from the following probes:

i) An air pressure probe 19 reads the pressure drop across the air or oxygen flow controller. This very simple system to control air flow to a burner is illustrated at the bottom right of the furnace 5. The probe is connected to microprocessor 16 by electrical or optical cables 18. The microprocessor 16 can read and scan the pressure drop across each air or oxygen flow controller 13 or the pressure drop across an array of flow controllers 13 and compare pressure drops across the total or part of the array of flow controllers 13 (e.g., internal consistency within an array) and adjust the flow controller 13 to achieve a preferred or desired oxygen or air pressure drop across the one or more burners 10 to a preferred value.

ii) A temperature probe 20, attached to the burner and measuring the flame temperature, as illustrated in another embodiment, shown at the bottom left of the furnace. The temperature probe 20 is attached to the microprocessor 16 by electrical or optical cables 18. The microprocessor 16 can compare the temperature of each burner or an array of burners to the array of burners or to the whole furnace and adjust the flow controller 13 to achieve a preferred or desired temperature at the one or more burners 12 to a preferred value.

iii) A temperature probe 21 is installed on the furnace wall proximate, typically within 5 feet (1.5 meter) from the burner (e.g., the radiant section of the furnace wall). This embodiment is illustrated at the top right of the furnace. The probe 21 may be directly connected to microprocessor 16 by electrical or optical cables 18. The microprocessor 16 can compare the temperatures of the furnace wall proximate the burner and adjust the flow controller 13 to achieve a preferred or desired wall temperature proximate the burner.

iv) Temperature probes 22 on a section of the coil 3, or furnace tubes, are a further embodiment illustrated in FIG. 1. The temperature probes 22 may be connected to the microprocessor 16 through electrical or optical line 18 (these connections to the line 18 are not shown in the FIGURE). The microprocessor 16 can compare the temperature profile of the coil or furnace tube external surface, to a set point temperature profile for the coil 3, or furnace tubes, and adjust the flow controller 13 to achieve a preferred or desired temperature profile for the coil 3, or furnace tubes.

The temperature inside a furnace, and particularly a cracking furnace may range from about 800° C. to about 1600° C. typically from 800° C. to 1200° C. and preferably from about 850° C. to 1100° C. The arch temperatures are about 1020° C. to 1080° C. These temperature ranges may require special high temperature coating for cables (either electrical or optical) which are used inside the furnace.

In the foregoing description of the invention, probes/sensors referred to as attached to the microprocessor 16 through electrical or optical cables 18, may be attached to the electrical or optical cables through a short bridging cable (not shown in the figures).

v) One or more (e.g., an array) remote sensor(s) 23 may be mounted on or adjacent to a furnace wall, in a further embodiment. The sensor 23 or array of sensors should be capable of scanning all or substantially all of the interior of the furnace 5. The sensor could be directed to the burner 10 to identify combustion products (e.g., such as those noted above in U.S. Pat. No. 7,838,297) at or proximate the burner. The sensor(s) is/are connected to microprocessor 16 by an electrical or optical cable 24. There are a number of remote sensors which might be used. Lasers could be used to determine chemical compositions and possibly temperature. Infrared imagers (e.g., camera) can be used to get accurate temperatures within the furnace. The microprocessor 16 would be programmed with a library of spectra for the combustion products of interest and would identify and quantify the combustion products of interest. Similarly, the microprocessor 16 would be programmed to identify the temperature at specified locations (e.g., location and camera sweep to focus on a particular area of the furnace interior). The microprocessor would be programmed to compare the combustion products or temperature (or temperature gradients or profiles) then adjust the air or oxygen flow controllers 13 to one or more burners to bring the furnace back to the desired state.

As noted above, the oxygen content in the exhaust gas in the arch 4 is preferably not more than about 1%, most preferable this is kept to below 0.8% (mass).

The variable air or oxygen flow controllers 13 may take a number of different mechanical embodiments. The variable air or oxygen flow controllers 13 could be a mechanical iris similar to that of a camera. The variable air or oxygen flow controllers 13 could comprise a damper. The variable air or oxygen flow controllers 13 could comprise two or more ½ moon shaped discs on a common pivot point which are movable relative to each other. The variable air or oxygen flow controllers 13 could comprise two or more ¼ moon shaped discs on a common pivot point which are movable relative to each other. The variable air or oxygen flow controllers 13 could comprise two or more plates having multiple small diameter holes (¼ inch or less) in each plate; said plates being rotatably mounted relative to each other and rotating the plates to increase or decrease the flow of oxygen. The variable air or oxygen flow controllers 13 could comprise an adjustable flow valve such as a ball valve or a throttle valve.

Typically, the variable air or oxygen flow controller 13 should have a fidelity of 1% or less, preferably 0.75% or less relative to the mass or volume of the air or oxygen passing through the controller 13.

The remote sensors could be selected from the group consisting of lasers and imaging devices (e.g., cameras). Both lasers and cameras could be used at the same or different locations to control the furnace.

While the invention has been described in terms of probes/sensors and flow controllers, one of ordinary skill in the art would understand that the present invention is not limited to using only one type of flow controller 13 or one type of sensor in the furnace. Combinations of sensors and flow controllers may be used in a single furnace design.

The preferred conditions for a burner or the furnace may be established using a number of methods. The microprocessor 16 may be programmed with the original operating design of the furnace. The target values could be defined by the air or oxygen requirement at its fuel consumption rate and given fuel composition. It is not beyond the scope of the present invention to use a positive/negative feedback or a neural network to define a preferred mode of operation.

As noted above, the microprocessor 16 may also be used to control the fuel rate to one or an array of burners. It is within the scope of this invention to use fuel rate as a method to control the oxygen content in the exhaust gases.

Depending on how the furnace is operated, the measurements maybe be taken on a periodic basis ranging from about once per second or less up to about once every 30 days (and all values in between). In the positive/negative feedback mode of operation, the measurements should be more frequent. The furnace tube, sometimes referred to as coil(s), may be a tube of a stainless steel which may be selected from the group consisting of wrought stainless, austenitic stainless steel and HP, HT, HU, HW and HX stainless steel, heat resistant steel and nickel based alloys. The coil pass may be a high strength low alloy steel (HSLA); high strength structural steel or ultra high strength steel. The classification and composition of such steels are known to those skilled in the art.

In one embodiment the stainless steel, preferably heat resistant stainless steel typically comprises from 13 to 50, preferably 20 to 50, most preferably from 20 to 38 weight % of chromium. The stainless steel may further comprise from 20 to 50, preferably from 25 to 50 most preferably from 25 to 48, desirably from about 30 to 45 weight % of Ni. The balance of the stainless steel may be substantially iron.

The present invention may also be used with nickel and/or cobalt based extreme austenitic high temperature alloys (HTAs). Typically the alloys comprise a major amount of nickel or cobalt. Typically the high temperature nickel based alloys comprise from about 50 to 70 weight % of Ni, preferably from about 55 to 65 weight % of Ni; from about 20 to 10 weight % of Cr; from about 20 to 10 weight % of Co; and from about 5 to 9 weight % of Fe and the balance one or more of the trace elements noted below to bring the composition up to 100 weight %. Typically the high temperature cobalt based alloys comprise from 40 to 65 weight % of Co; from 15 to 20 weight % of Cr; from 20 to 13 weight % of Ni; less than 4 weight % of Fe and the balance one or more trace elements as set out below and up to 20 weight % of W. The sum of the components adding up to 100 weight %.

Newer alloys may be used which contain up to about 12% Al, typically less than 7 weight % Al, generally about 2.5 to 3 weight % aluminum as disclosed, for example, in U.S. Pat. No. 7,278,828 issued Oct. 9, 2007 to Steplewski et al., assigned to General Electric Company. Typically in the high cobalt and high nickel steels the aluminum may be present in an amount up to 3 weight %, typically between 2.5 and 3 weight %. In the high chrome high nickel alloys (e.g. 13 to 50 weight %, preferably 20 to 50 weight % of Cr and from 20 to 50 weight % of Ni) the aluminum content may range up to 10 weight %, preferably less than about 7 weight %, typically from about 2 to 7 weight %.

In some embodiments of the invention, the steel may further comprise a number of trace elements including at least 0.2 weight %, up to 3 weight %, typically 1.0 weight %, up to 2.5 weight %, preferably not more than 2 weight % of manganese; from 0.3 to 2 weight %, preferably 0.8 to 1.6 weight %, typically less than 1.9 weight % of Si; less than 3 weight %, typically less than 2 weight % of titanium, niobium (typically less than 2.0 weight %, preferably less than 1.5 weight % of niobium) and all other trace metals; and carbon in an amount of less than 2.0 weight %. The trace elements are present in amounts so that the composition of the steel totals 100 weight %.

The FIGURE is schematic and in the furnace section the coil 3, or furnace tube, is shown as a simple "loop". In practice in the furnace sections the coil is serpentine in shape and comprises a number of passes (similar to those shown in the arch).

To improve heat transfer to furnace tube or coils one or more longitudinal vertical fins are added to the external surface of the process coil, at least to a portion of one or more passes in the cracking furnace radiant section.

Typically, there could be from 1 to 8, preferably from 1 to 4, more preferably 1 or 2 longitudinal vertical fins, on the external surface of at least a portion of the coil single pass or, preferably, on more than one coil passes. If more than one fin is present, the fins may be radially evenly spaced about the outer circumference of the coil pass (e.g. two fins spaced 180° or four fins spaced 90° apart on the outer circumference of the coil pass). However, the fins spacing could be asymmetric. For example, in the non-limiting case of two fins, the fins could be asymmetrically placed from 30° to 270°, typically from 60° to 200°, preferably from 60° to 120°, radially apart on the external circumference of the radiant coil.

In one embodiment, the fin(s) are longitudinal vertical fins. The longitudinal vertical fins may have a number of cross sectional shapes, such as rectangular, square, triangular or trapezoidal. A trapezoidal shape may not be entirely intentional, but may arise from the manufacturing process, for example, when it is too difficult or costly to manufacture (e.g., cast or machine) a triangular cross section.

The fins can extend from 10% to 100% (and all ranges in between) of the length of a coil pass (e.g., the length of one arm of a serpentine loop in the furnace tube). However, the length ($L_h$) of the fin and location of the fin need not be uniform along all of the coil passes. In some embodiments of the invention, the fin could extend from 15 to 100%, typically from 30% to 100%, generally from 50% to 100% of the length of the pass of the radiant coil and be located at the bottom, middle or top of the pass. In further embodiments of the invention the fin could extend from 15% to 95%, preferably from 25% to 85% of the length of the coil pass and be located centrally along the coil or be off set to the top or the bottom of the pass.

A fin may have at its base at the external circumference of the radiant coil, a width (Ls) from 3% to 30% of the coil outer diameter, typically from about 6% to 25%, preferably from 7% to 20%, most preferably from 7.5% to 15% of the coil outer diameter.

A fin may have a height ($L_z$) above the surface of the radiant coil from 10% to 50% of the coil outer diameter and all the ranges in between, preferably from 10% to 40%, typically from 10% to 35% of the coil outer diameter. The fins placed along coil passes may not have identical sizes in all locations in the radiant section, as the size of the fin may be selected based on the radiation flux at the location of the coil pass (3) (e.g., some locations may have a higher flux than others—corners).

In designing the fin, care must be taken so that the fin adsorbs more radiant energy than it may radiate. This may be restated as the heat being transferred from the fin into the coil (through the base of the fin on the external surface of the coil) must be larger than the heat transferred through the same area on the surface of the bare finless coil. If the fin becomes too big (too high or too wide), the fin may start to reduce heat transfer, due to thermal effects of excessive conductive resistance (e.g., the fin radiates and gives away more heat than it absorbs), which defeats the purpose of the fin. Under the conditions of operation/use the transfer of heat through the base of the fin into the coil must exceed that transferred to the equivalent surface on a bare finless coil at the same conditions.

A coil pass may have a length from about 1.5 to 8 m, typically furnace tubes will have an outside diameter from 2 to 7 inches (e.g., 2 inch, 3 inch, 3.5 inch, 6 inch and 7 inch outside diameter) (about 3.7 to 20 cm; typically about 5 to 16.5 cm (e.g., about 5 cm, about 7.6 cm, about 8.9 cm, about 15.2 cm and about 20 cm)) in outside diameter.

The fin(s) may comprise from 3% to 45%, preferably from 5% to 30% of the weight of the coil pass. One of the issues to consider is the creep of the coil pass given the additional weight of the fins. Therefore, preferably, the fin(s) is an integral part of the coil pass and may be formed by casting the tube and/or machining a cast tube. As a result, preferably, the fin material has the same composition as the material of the pass of the radiant coil.

The fins described are more fully described in U.S. Patent Application US2012/0251407 filed Feb. 28, 2012, claiming a priority date of Mar. 31, 2011. The disclosure within U.S. Patent Application US2012/0251407 is incorporated by reference in its entirety.

In an alternative embodiment, the external surface of the coil, at least in a portion of one or more passes in the cracking furnace radiant section, is augmented with relatively small protuberances.

The protuberances may be evenly spaced along the pass or unevenly spaced along the pass. The proximity of the protuberances to each other may change along the length of the pass or the protuberances may be evenly spaced but only on portions of the tube, or both. The protuberances may be more concentrated at the upper end of the pass in the radiant section of the furnace.

The protuberances can cover from 10% to 100% (and all ranges in between) of the external surface of the coil pass (3). In some embodiments of the invention, the protuberances may cover from 40 to 100%, typically from 50% to 100%, generally from 70% to 100% of the external surface of the pass of the radiant coil. If protuberances do not cover the entire coil pass, but cover less than 100% of the pass, they can be located at the bottom, middle or top of the pass (3).

A protuberance base is in contact with the external coil surface. A base of a protuberance has an area not larger than 0.1% to 10% of the coil cross sectional area.

The protuberance may have geometrical shape, having a relatively large external surface that contains a relatively small volume, such as for example tetrahedrons, pyramids, cubes, cones, a section through a sphere (e.g., hemispherical or less), a section through an ellipsoid, a section through a deformed ellipsoid (e.g. a tear drop), etc. Some useful shapes for a protuberance include:

a tetrahedron (pyramid with a triangular base and 3 faces that are equilateral triangles);

a Johnson square pyramid (pyramid with a square base and sides which are equilateral triangles);

a pyramid with 4 isosceles triangle sides;

a pyramid with isosceles triangle sides (e.g., if it is a four faced pyramid the base may not be a square it could be a rectangle or a parallelogram);

a section of a sphere (e.g., a hemi sphere or less);

a section of an ellipsoid (e.g., a section through the shape or volume formed when an ellipse is rotated through its major or minor axis); and.

a section of a tear drop (e.g., a section through the shape or volume formed when a non uniformly deformed ellipsoid is rotated along the axis of deformation); or a section of a parabola (e.g., section though the shape or volume formed when a parabola is rotated about its major axis—a deformed hemi- (or less) sphere), such as e.g., different types of delta-wings.

The selection of the shape of the protuberance is largely based on the ease of manufacturing the pass or tube. One method for forming protuberances on the pass is by casting in a mold having the shape of the protuberance in the mold wall. This is effective for relative simple shapes. The protuberances may also be produced by machining the external surface of a cast tube such as by the use of a knurling device, for example, a knurl roll.

The above shapes are closed solids.

The size of the protuberance must be carefully selected. The smaller the size, the higher is the surface to volume ratio of a protuberance, but it may be more difficult to cast or machine such a texture. In addition, in the case of excessively small protuberances, the benefit of their presence may become gradually reduced with time due to settlement of different impurities on the coil surface. However, the protuberances need not be ideally symmetrical. For example, an elliptical base could be deformed to a tear drop shape, and if so shaped preferably the "tail" may point down when the pass is positioned in the furnace.

A protuberance may have a height ($L_z$) above the surface of the radiant coil from 3% to 15% of the coil outer diameter, and all the ranges in between, preferably from 3% to 10% of the coil outer diameter.

In one embodiment, the concentration of the protuberances is uniform and covers completely the coil external surface. However, the concentration may also be selected based on the radiation flux at the location of the coil pass (3) (e.g., some locations may have a higher flux than others—corners).

In designing the protuberances, care must be taken so that they adsorb more radiant energy than they may radiate. This may be restated as the transfer of heat through the base of the protuberance into the coil must exceed that transferred to the equivalent surface on a bare finless coil at the same operational conditions. If the concentrations of the protuberances become excessive and if their geometry is not selected properly, they may start to reduce heat transfer, due to thermal effects of excessive conductive resistance, which defeats the purpose of the invention. The properly designed and manufactured protuberances will increase net radiative and convective heat transferred to a coil from the surrounding flowing combustion gasses, flame and furnace refractory. Their positive impact on radiative heat transfer is not only because more heat can be absorbed through the increased coil external surface so the contact area between combustion gases and coil is increased, but also because the relative heat loss through the radiating coil surface is reduced, as the coil surface is not smooth any more. Accordingly, as a protuberance radiates energy to its surroundings, part of this energy is delivered to and captured by other protuberances, thus it is re-directed back to the coil surface. The protuberances will also increase the convective heat transfer to a coil, due to the increase in coil external surface that is in contact with flowing combustion gas, but also by increasing turbulence along the coil surface and by reducing the thickness of a boundary layer.

The protuberances may comprise up to 10% to 35% of the weight of the coil pass. One of the limiting issues to consider is the creep of the coil pass given the additional weight of the protuberances. This may also affect the location and concentration of the protuberances. It may reduce creep if there are more protuberances on the upper surface of the pass. Preferably, the protuberances are an integral part of the coil pass and may be formed by casting or machining a cast tube. As a result, preferably, the protuberance material has the same composition as the material of the pass of the radiant coil. Obviously, cost will be a consideration in the selection of the shape of the protuberance and its method of production.

The present invention provides a furnace, preferably an ethylene cracking furnace comprising the components as described above.

The present invention has been described in the context of a balanced forced air draft furnace comprising one or more fans and one or more air ducts. However, the concepts presented herein could be equally applicable to a naturally aspirated air burner. In such an embodiment, the fans and the duct work would be absent but the remaining components of the furnace (e.g., sensors, microprocessor, and adjustable apertures) would be present and used without the fan and duct work.

The present invention has been described with reference to specific details of particular embodiments thereof. It is not intended that such details be regarded as limitations upon the scope of the invention except insofar as and to the extent that they are included in the accompanying claims.

What is claimed is:

1. An ethylene cracking furnace comprising:

an exhaust;

one or more combustion chambers having two or more gaseous fuel burners each having one or more associated variable forced oxidant apertures and one or more associated flow controllers that individually control an oxidant flow to each fuel burner having a control fidelity of 1% of said oxidant flow at its maximum flow rate and an array of one or more first probes to measure the air pressure drop across each of said one or more flow controllers, said fuel burners drawing oxidant only from a common duct system;

a fan and said common duct system attached to and feeding said one or more forced oxidant apertures;

one or more process coils;

one or more radiant walls, and;

one or more additional probes taking a measurement of a) the temperature of two or more fuel burner flames;

b) the temperature of one or more section(s) of said one or more radiant walls within 5 feet of said fuel burner;

c) the temperature gradient across said one or more process coils;

d) one or more combustion product(s) produced by said two or more fuel burners;

e) a mass flow rate or a volume flow rate of said oxidant flow to each fuel burner;

f) the air pressure drop across said one or more flow controllers;

a microprocessor connected to said probes, said microprocessor being programmed to compare a desired operating condition(s) to said measurement(s) obtained from said probes, said microprocessor communicating with said one or more flow controllers to make an adjustment to said variable forced oxidant apertures, wherein said adjustment increases or decreases the opening in said apertures, increasing or decreasing said oxidant flow, to achieve the desired operating conditions; wherein said oxidant is air or oxygen or mixtures thereof.

2. The cracking furnace according to claim 1, wherein said variable forced air aperture comprises a mechanical iris.

3. The cracking furnace according to claim 1, wherein said variable forced air aperture comprises a damper.

4. The cracking furnace according to claim 1, wherein said variable forced air aperture comprises two or more ½ moon shaped discs on a common pivot point movable relative to each other.

5. The cracking furnace according to claim 1, wherein said variable forced air aperture comprises two or more ¼ moon shaped discs on a common pivot point movable relative to each other.

6. The cracking furnace according to claim 1, wherein said variable forced air aperture comprises two or more plates having multiple holes having a diameter of ¼ inch or less in each plate; said plates being rotatably mounted relative to each other and rotating said plates increases or decreases said air flow.

7. The cracking furnace according to claim 1, wherein said variable forced air aperture comprises a valve.

8. The cracking furnace according to claim 1, wherein the probes include one or one or more devices distant from the point of measurement.

9. The cracking furnace according to claim 8, wherein the probes distant from the point of measurement are selected from the group consisting of lasers and cameras.

* * * * *